US008608339B2

(12) United States Patent
Gerli et al.

(10) Patent No.: US 8,608,339 B2
(45) Date of Patent: Dec. 17, 2013

(54) LIGHTING DEVICE

(75) Inventors: Alberto Gerli, Padua (IT); Andrea Guazzora, Vicenza (IT)

(73) Assignee: Arianna S.p.A., Padua (IT)

( * ) Notice: Subject to any disclaimer, the term of this patent is extended or adjusted under 35 U.S.C. 154(b) by 163 days.

(21) Appl. No.: 13/139,802

(22) PCT Filed: Dec. 11, 2009

(86) PCT No.: PCT/IB2009/055710

§ 371 (c)(1),
(2), (4) Date: Jul. 15, 2011

(87) PCT Pub. No.: WO2010/070565

PCT Pub. Date: Jun. 24, 2010

(65) Prior Publication Data

US 2011/0261565 A1 Oct. 27, 2011

(30) Foreign Application Priority Data

Dec. 15, 2008 (IT) ..... TV2008A0162
Feb. 20, 2009 (IT) ..... TV2009A0018
Feb. 20, 2009 (IT) ..... TV2009A0019

(51) Int. Cl.
*F21V 5/04* (2006.01)

(52) U.S. Cl.
USPC ..... 362/235; 362/241; 362/243; 362/247

(58) Field of Classification Search
USPC ..... 362/235, 241, 243, 247, 346, 607, 623, 362/800
See application file for complete search history.

(56) References Cited

U.S. PATENT DOCUMENTS

2007/0217193 A1 9/2007 Lin et al.

FOREIGN PATENT DOCUMENTS

| | | | |
|---|---|---|---|
| DE | 20313899 | U1 | 12/2003 |
| EP | 1918634 | A1 | 5/2008 |
| WO | WO2005055328 | A1 | 6/2005 |
| WO | WO2007022314 | A2 | 2/2007 |
| WO | WO2007130536 | A2 | 11/2007 |
| WO | WO2008103379 | A1 | 8/2008 |

*Primary Examiner* — Vip Patel
(74) *Attorney, Agent, or Firm* — Tutunjian & Bitetto, P.C.

(57) ABSTRACT

An outdoor lighting device for lighting a target, particularly for use in street lighting, includes a support structure and a lighting unit stably associated with the support structure and having one or more light beam sources of LED type, with preset FWHM values, and one or more reflecting surfaces designed to at least partially reflect light beams. At least a first one of the LED sources has the FWHM of its luminous spectrum totally reflected by one or more of the reflecting surfaces and totally projected towards the target for increased lighting efficiency.

8 Claims, 5 Drawing Sheets

LIGHTING DEVICE

DEFINITIONS

As used herein, the term FWHM will have the following meaning.

FWHM: Full Width at Half Maximum (FWHM) expresses the width of a function given by the difference between the values of the independent variable when the dependent variable is half its maximum value. In the field of lighting as is concerned herein, the independent variable is the arc of the projection cone of the light beams emitted from a source, and the dependent variable is the emitted luminous intensity. Therefore, in other words, the FWHM identifies the emission cone of about 80% the luminous energy emitted from the source.

FIELD OF INVENTION

The present invention generally finds application in the field of lighting, and particularly relates to outdoor lighting devices.

Namely, the present invention relates to lighting devices particularly suitable for street lighting.

BACKGROUND ART

Most of the research and development efforts in the field of lighting devices are known to be aimed at maximizing lighting efficiency.

This need is particularly felt especially for outdoor lighting devices, where the light beam should be optimally directed, because any dispersed light beams are totally lost, unlike indoor lighting, where some reflection is provided by surrounding walls.

Particularly significant examples are street lighting applications, where the target to be lighted is particularly small, whereby the light beams emitted from light sources must be accurately directed.

A light source is known to emit light beams substantially in all directions. This means that a considerable part of these beams cannot light the target and is thus lost.

In this respect, the prior art provides lighting devices in which the light source is surrounded by reflecting surfaces on all the sides that do not face the target. These surfaces may have various shapes, but are all aimed at optimizing the collection of light beams that would otherwise be lost and reflecting them towards the target.

This will afford a considerably improved luminous efficacy, but it does not provide relevant results due to other drawbacks.

First, since the device is generally placed at a considerable distance from the target, many light beams are anyway dispersed.

Furthermore, the light sources that are generally used, i.e. incandescent, halogen or fluorescent sources have such a size as to act themselves as a screen for most of the light beams, which are thus irreparably lost.

In an attempt to improve these results, lighting devices are known that use LEDs. These can be generally approximated to point-like light sources, and hence at least partially obviate the problem of the screen effect of the source. Nevertheless, they increase the problem of substantially even distribution of light emission in all directions, which decreases their luminous efficacy on the target.

WO20081103379 discloses a LED lighting system. However, nowhere in this prior art there is mentioned the FWHM of its luminous spectrum or its reflection by at least one of the reflecting surfaces and projection towards a target.

Moreover, the outwardly directed aperture is not facing toward the target but toward a remote reflector.

Lighting devices are also known which use refractive or Fresnel lenses to improve the directivity of the emitted light beam. However, little improvements are obtained also in this case.

SUMMARY

An object of the present invention is to at least partially overcome the above drawbacks, by providing a lighting device that affords a higher luminous efficacy than equivalent prior art devices.

Namely, one object of the present invention is to provide a lighting device that can maximize recovery of all the light beams emitted from a light source that, in equivalent prior art devices, do not propagate directly towards the target.

One more object of the present invention is to provide a lighting device that reduces the loss of light beams due to the screen effect of the light beam source itself.

A further object is to provide a lighting device that is particularly suitable for outdoor use, e.g. for street lighting.

These and other objects, as better explained hereafter, are fulfilled by an outdoor lighting device, particularly designed for street lighting applications, as defined in the main claim. Advantageous embodiments of the invention are defined in accordance with the dependent claims.

According to one aspect of the invention, the lighting device may include a support structure and a lighting unit stably associated with the support structure. The lighting unit may in turn include one or more light beam sources of the LED type and one or more reflecting surfaces designed to at least partially reflect the light beams.

In another aspect of the invention, at least a first one of the LED sources has the FWHM of its luminous spectrum totally reflected by at least one of the reflecting surfaces and totally projected towards a target, for increased lighting efficiency.

In other words, considering the FWHM definition given above, at least one LED of the inventive lighting device has most of its light beam totally reflected or conveyed towards the target. This will ensure that such considerable part of the light beam is not even partially dispersed, and thus that luminous efficacy is increased as compared with prior art lighting devices.

As an obvious result, the greater the number of LED sources having the FWHM of their luminous spectrum totally reflected by at least one of the reflecting surfaces, the more the luminous efficacy of the inventive device will be increased.

According to a further aspect of the invention, the reflecting surfaces will include first reflecting surfaces and second reflecting surfaces, wherein:

- the first reflecting surfaces are susceptible of reflecting the light beams impinging upon them towards the target and/or the second reflecting surfaces;
- the second reflecting surfaces are susceptible of reflecting the light beams impinging upon them towards the target.

In other words, the two sets of reflecting surfaces define two reflective sets, the first set acting as a collector for the light beams emitted from the first LED source and as a projector that directs some of these beams directly towards the target, and the second set only acting as a projector and deflecting all the collected beams transmitted thereto from the first set towards the target.

This advantageously allows the two reflective sets to be shaped as desired. Particularly, the first set can be shaped in view of collecting and conveniently deflecting a light beam much larger than that contained in the FWHM, thereby further increasing the efficacy of the inventive device.

The freedom with which the second set may be formed also allows light beams to be projected with the desired aperture and to be directed towards the desired target.

BRIEF DESCRIPTION OF THE DRAWINGS

Further characteristics and advantages of the invention will be more apparent from the detailed description of a few preferred, non-exclusive embodiments of an outdoor lighting device, particularly for street lighting applications, according to the invention, which are described as non-limiting examples with the help of the annexed drawings, in which.

DETAILED DESCRIPTION OF PREFERRED EMBODIMENTS

Figure 1:
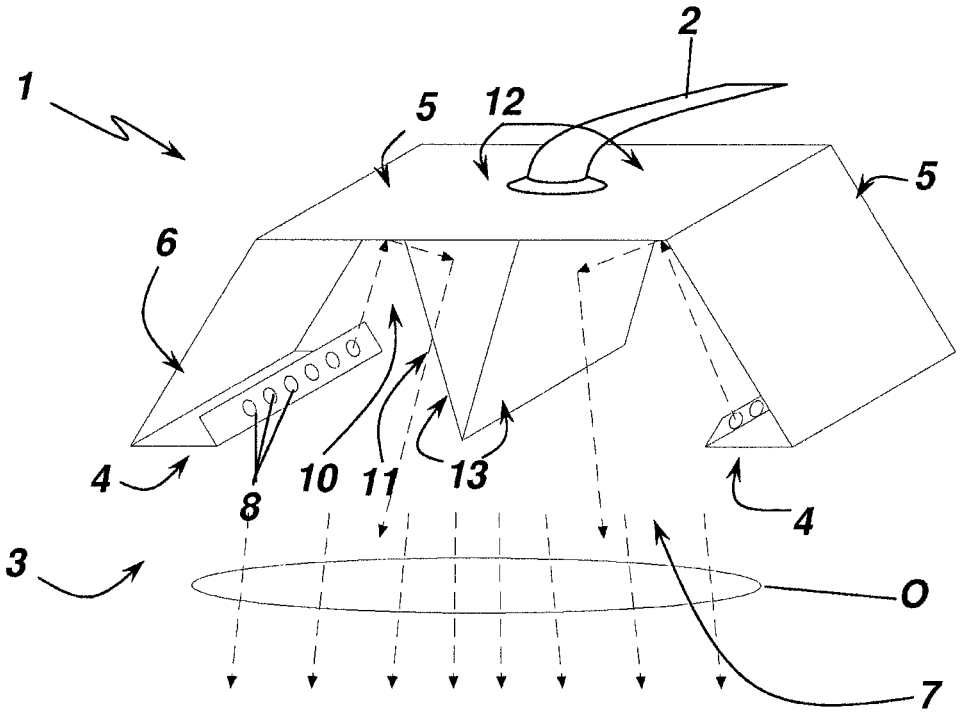
FIG. 1 is a schematic view of a lighting device of the invention.
Figure 2:
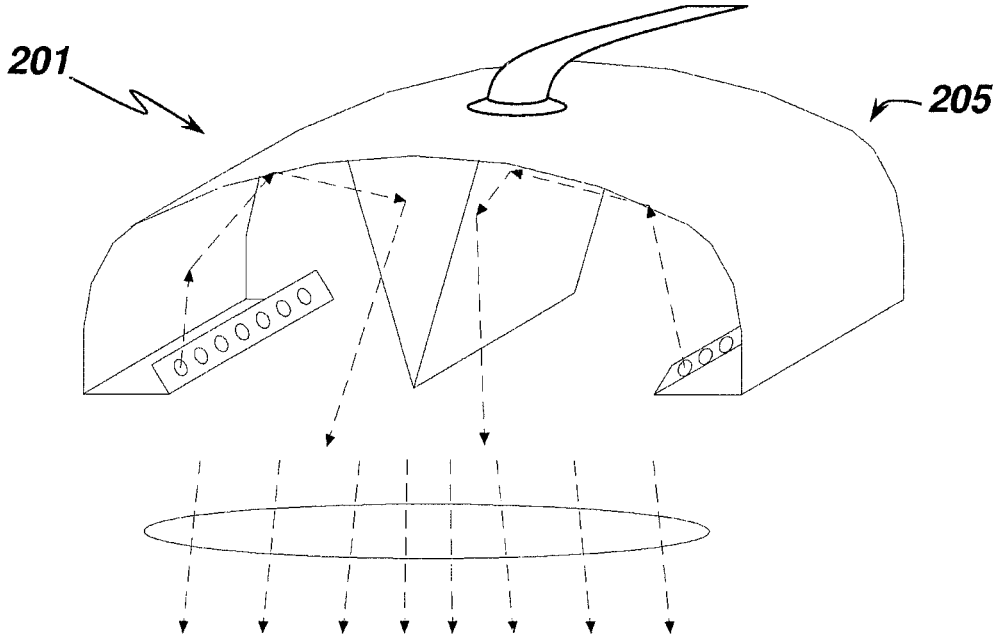
FIGS. 2 to 4 show different embodiments of the invention.
Figure 3:
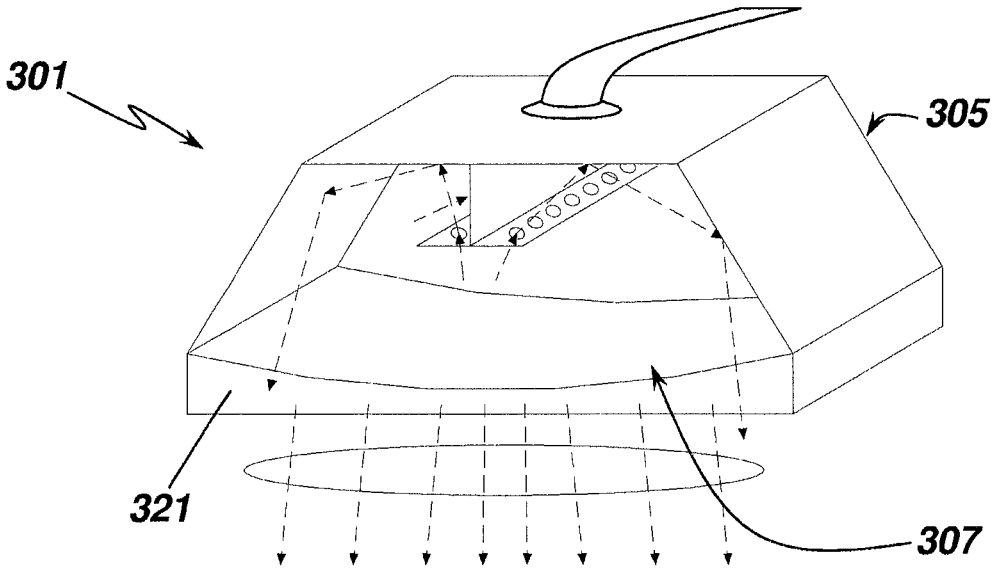
Figure 4:
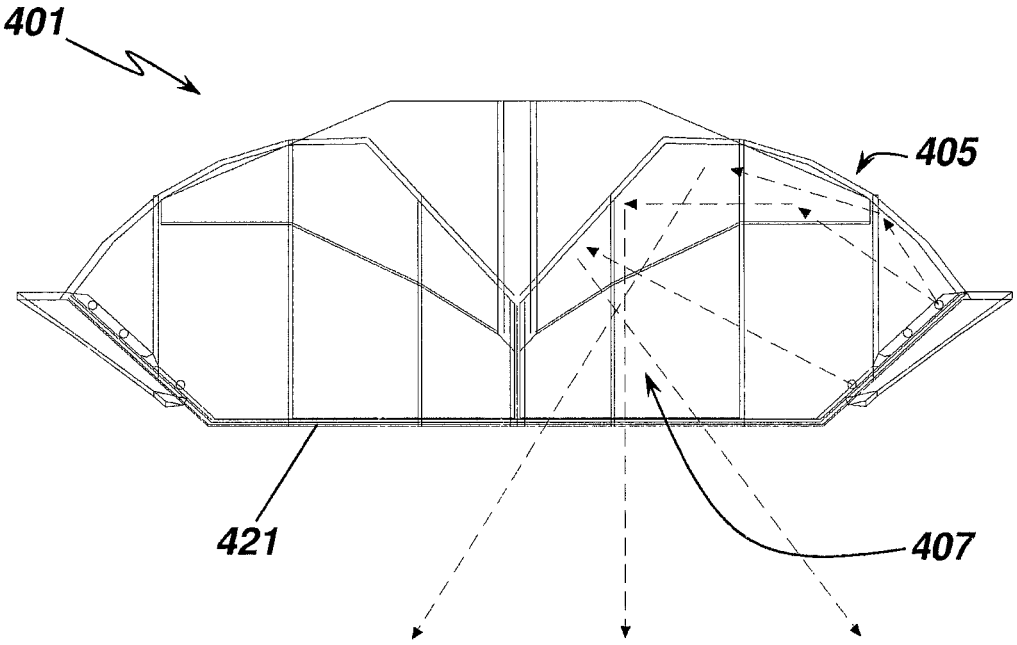
Figure 5:
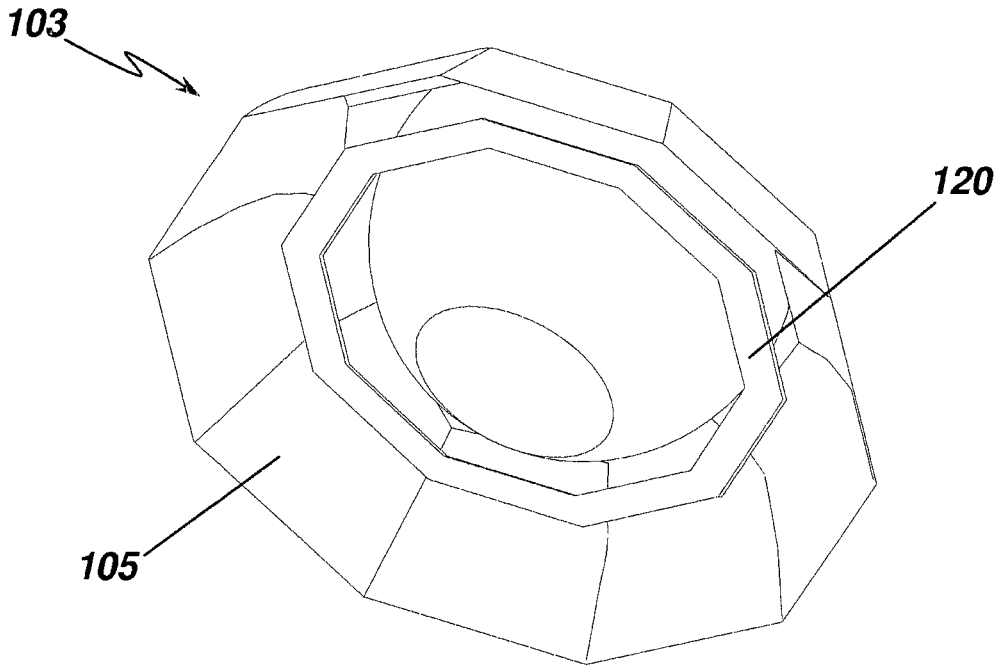
FIG. 5 is a schematic view of a further embodiment of the invention.
Figure 6:
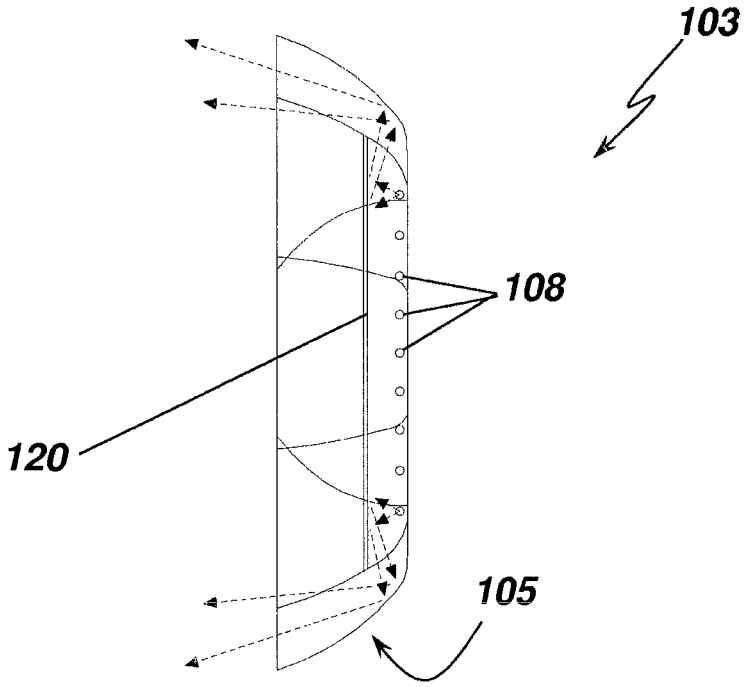
FIG. 6 is a perspective view of the embodiment of FIG. 5.

Referring to the above figures, there is disclosed herein an outdoor lighting device 1 particularly suitable for street lighting.

The lighting device 1 is shown to include a support structure 2 and a lighting unit 3 stably associated with the support structure.

In one aspect of the invention, the lighting unit 3 comprises one or more light beam sources 4 of the LED type. Like all prior art light sources, LEDs also have FWHM values that depend on LED construction parameters, and are thus predetermined.

The use of LEDs provides certain advantages. First, as mentioned above, a LED source generally has a small size within the lighting device, which involves a lower reduction of luminous efficacy due to the shadow cone created by the source itself, as compared with incandescent, fluorescent, halogen or the like sources.

Furthermore, the use of LED sources affords the well-known advantages of such sources, such as reduced power consumption with the same luminous energy being emitted.

In another aspect of the invention, the lighting unit 3 also comprises one or more reflecting surfaces 5 designed to at least partially reflect the light beams emitted from the LED sources 4.

As shown, for instance, in FIG. 1, at least one subset of reflecting surfaces 5 are associated together to define a hollow body 6 having an aperture 7 facing towards the target O. The LED sources 4 are arranged within the hollow body 6.

As mentioned above, such arrangement is designed as an attempt to properly direct all the light beams emitted in directions other than the desired one. Nevertheless, as mentioned above, in prior art lighting devices, luminous efficacy cannot be considerably increased since the reflecting surfaces are generally placed behind or beside the light sources to receive the light beams emitted in such directions.

Conversely, according to the invention as disclosed herein, the reflecting surfaces 5 have such a shape that at least a first one 8 of the LED sources 4 has the FWHM of its luminous spectrum totally reflected by at least one of the reflecting surfaces 5 and totally projected towards a target O, for increased lighting efficiency of the device 1.

In short, at least one LED source in the lighting device 1 has most of its light beam totally reflected or conveyed towards the target O. This will ensure that such considerable part of the light beam is not even partially dispersed, and thus that luminous efficacy is increased as compared with prior art lighting devices.

In view of the above, according to another aspect of the invention, all the LED sources 4 have the FWHM of their luminous spectra totally reflected by at least one of the reflecting surfaces 5, thereby maximizing the luminous efficacy increase obtained by such arrangement.

FIG. 1, which shows a possible embodiment of the invention, indicates by broken arrows the paths of certain light beams emitted by first LED sources 8 whose FWHM is totally reflected by at least one reflecting surface 5.

Referring to the embodiments of FIGS. 1 to 4, it will be noted that the lighting devices 1, 201, 301, 401 have their reflecting surfaces 5, 205, 305, 405 in identical arrangements, but with different outer shapes of each lighting device 1, 201, 301, 401.

In another aspect of the invention, the reflecting surfaces will include first reflecting surfaces 10 and second reflecting surfaces 11.

Namely, the first reflecting surfaces 10 are susceptible of reflecting the light beams impinging upon them towards the target O and/or the second reflecting surfaces 11, whereas the latter are susceptible of reflecting the light beams impinging upon them towards the target O.

Therefore, as mentioned above, the two sets of reflecting surfaces 5 define two reflective sets 12, 13, the first set 12 acting as a collector for the light beams emitted from the first LED source 8 and as a projector that directs some of these beams directly towards the target O, and the second set 13 only acting as a projector and deflecting all the collected beams transmitted thereto from the first set 12 towards the target O.

This advantageously allows the two reflective sets 12, 13 to be shaped and arranged as desired, as shown in the figures. Particularly, the first set 12 can be generally shaped in view of collecting and conveniently deflecting a light beam much larger than that contained in the FWHM, thereby further increasing the efficacy of the inventive device. Furthermore, the second set may be formed to project light beams with the desired aperture and direct them towards the desired target O in the most convenient manner.

It will be also appreciated that, in another aspect of the invention, as exemplified in the embodiments of FIGS. 1 to 4, the direction of propagation of each of the light beams within the FWHM of the luminous spectrum emitted from the first LED sources 8 diverges from the line that joins such first LED sources 8 and the target O. In other words, the first LED sources 8 do not face towards the target O, but towards the reflecting surfaces 5. This further clarifies the inventive concept of the lighting device 1, i.e. that all the beams within the FWHM emitted from the first LED sources 8 are reflected before reaching the target O.

The embodiments described heretofore are substantially optical light beam collecting and projecting systems, that can be compared in their operation to a tube of optical refractive material, known in the art as a waveguide. The operation of waveguides is partially based on the known principle of total internal reflection in refractive materials having a refractive index above the one of the medium external thereto, according to the known equation:

$$\theta_i = \arctan\frac{n_2}{n_1},\ n_1 > n_2$$

where $n_1$ is the refractive index of the waveguide material, $n_2$ is the refractive index of the medium surrounding the waveguide and $\theta_i$ is the minimum angle of incidence of light beams upon the inner walls of the waveguide above which all the light is reflected.

Waveguides collect almost the entire emission from light sources of typical LED size, and then propagate it therethrough thereby minimizing losses and forcing light to follow the geometrical shape of the guides, by virtue of the above equation, which applies to most of internal reflections sequentially along the inner surfaces of the guides. Thus, a considerable part of the luminous energy initially emitted from the source towards a target may be also placed at large inclinations to the direction of the emission peak of the source.

The systems described hereintofore use appropriately shaped reflecting surfaces to implement the same method of conveying light through preset paths and projecting it towards a target that may also be strongly inclined to the direction of the emission peak of the LED, and to considerably improve light transmission efficiency as compared with waveguides made of an optical refractive material.

A slightly different concept, but still falling within the scope of the invention as disclosed hereinbefore, is expressed in the embodiments of FIGS. 5 to 8. Here, it will be noted that, unlike the previous embodiments, the first LED sources 108, 508 of the lighting unit 103, 503 face towards the target. Nevertheless, in a further aspect of the invention, the optical path of the emitted light beams that fall within the FWHM of the first LED sources 108, 508 impinges upon at least one 120, 520 of the reflecting surfaces 105, 505. Therefore, once more, all the light beams within the FWHM of the first LED sources 108, 508 are totally reflected by at least one reflecting surface 105, 505 before reaching the target.

Figure 7:
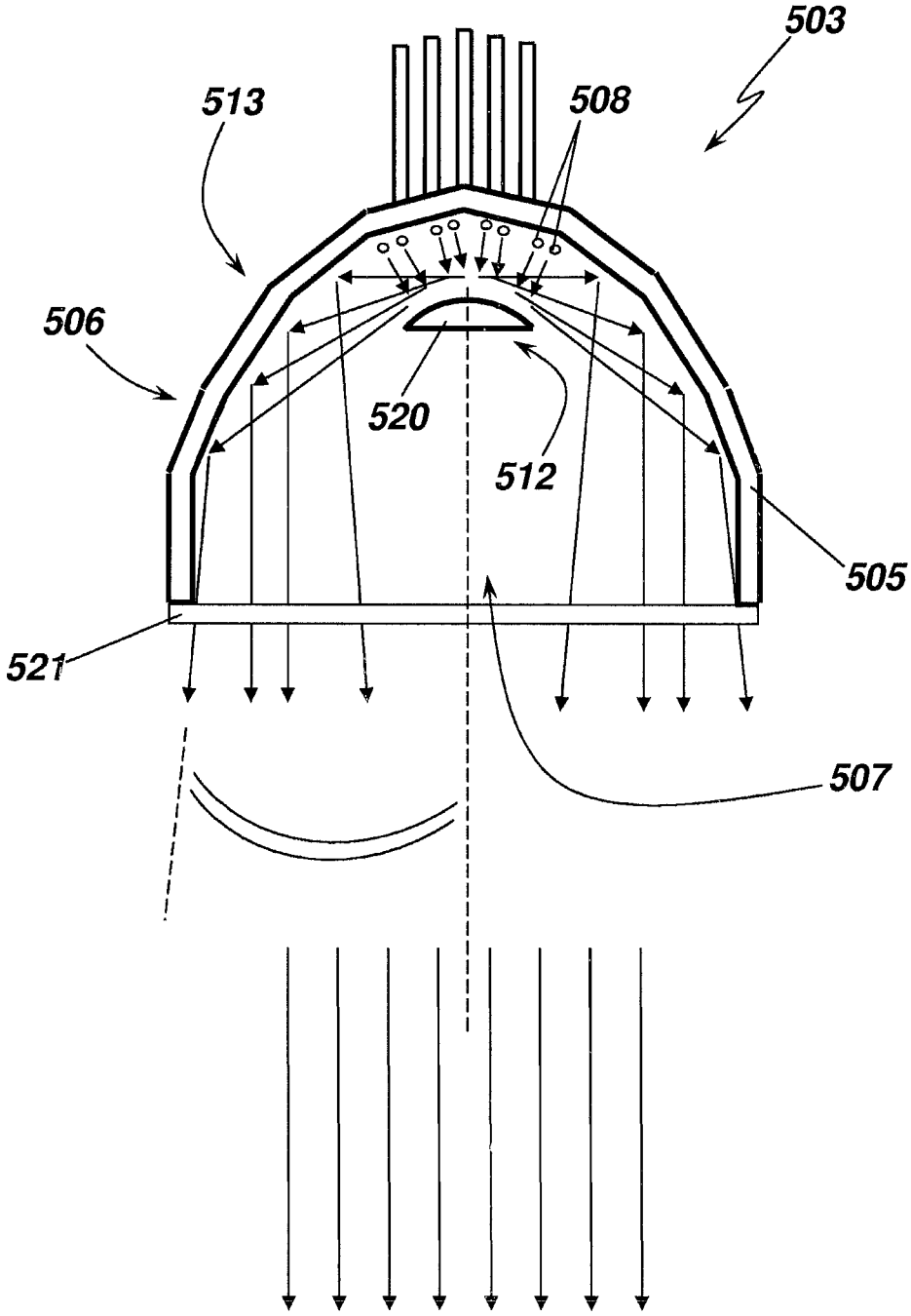
FIG. 7 is a schematic view of another embodiment of the invention.
Figure 8:
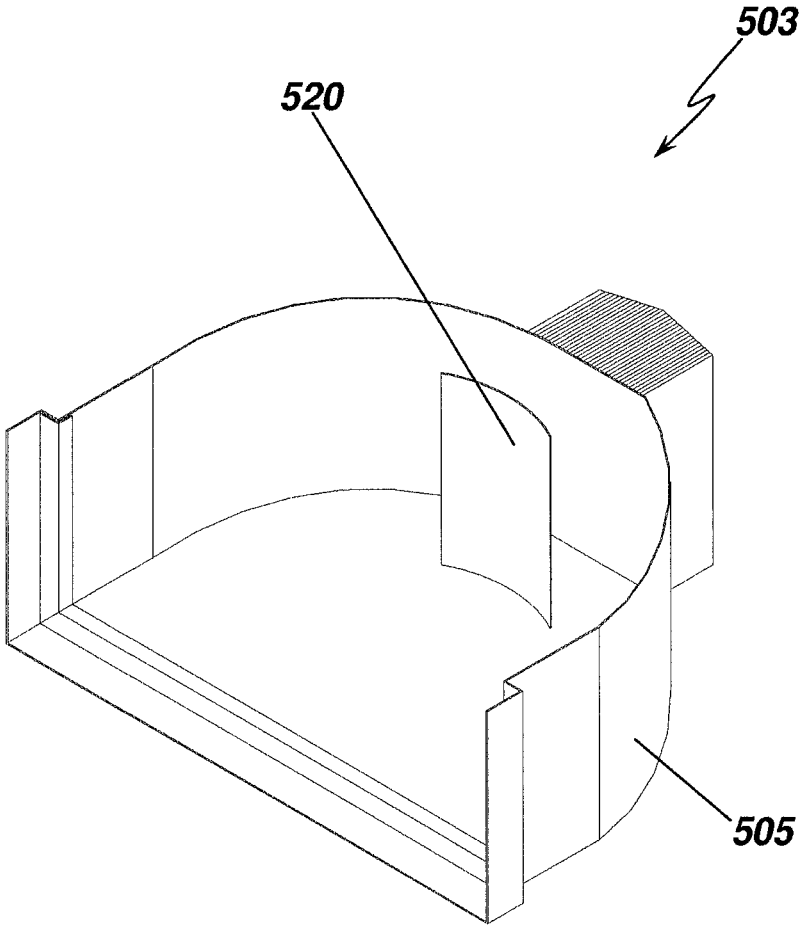
FIG. 8 is a perspective view of the embodiment of FIG. 7.

The embodiment of FIGS. 7 and 8 will be more particularly described below. Here, the second set of reflecting surfaces 513 form a substantially curvilinear bell-like element, whereas the first set 512 is formed of a single reflecting surface 505 also substantially curvilinear and contained in the space within the hollow body 506 formed by the second set 513 and having an aperture 507 facing towards the target O. The hollow body 506 also contains the LED sources 504 that are joined to the target, as mentioned above, by lines passing through the reflecting surface 505 that forms the second set 513.

This embodiment conceptually reproduces the optics of a back focus telescope, such as a Cassegrain or a Maksutov telescope, or derivatives thereof. In astronomical applications, it is assumed to a good degree of approximation that the light from celestial bodies reaches the telescope in the form of substantially parallel light beams. The double-reflection optics of the telescope operates by converging such light beams to a focus corresponding to the focus of the eyepiece on which the observer's eye generally rests.

Therefore, inversely, if a first LED source 508 is placed in such focus, the light beams emitted from the lighting device will be substantially parallel and will light a well-delimited area with high lighting efficiency.

In another aspect of the invention, the aperture 307, 407, 507 of the hollow body 306, 406, 506 is at least partially closed by a lens 321, 421, 521. Particularly, such lens 321, 421, 521 may be of the refractive or Fresnel type, which affords a further improvement in the directivity of light beams and in lighting efficiency.

The embodiments of the inventive concept as disclosed above derive from the known equations of astronomical optics.

$$1/f=1/f1+1/f2-d/f1f2;\ f>f1;\ f1>0;\ f2<0;\ -1/|f2|+d/f1|f2|<0 \Rightarrow d<f1;$$

where f is the focal length of a double-mirror Cassegrain telescope, f1 is the focal length of the primary mirror and f2 is the focal length of the secondary mirror.

These embodiments may be defined as "back reflection systems", most of the light emitted from the LEDs being reflected at angles above 90° to the direction of emission, and hence being actually reflected backwards to second optical projection units, which in turn reflect it at final angles below 90° to the direction of emission and finally forwards to the target. In other words, the optical path of the light beams within the FWHM of the first LED source 8, 108, 508 has at least two adjacent portions that define together an angle of at least 90°.

Due to the above, it will be appreciated that the lighting device of the invention fulfills all the intended objects.

Particularly it affords improved luminous efficacy as compared with equivalent prior art devices, and can maximize recovery of all the light beams emitted from a light source that, in equivalent prior art devices, do not propagate directly towards the target.

Furthermore, the present lighting device reduces the loss of light beams due to the screen effect of the light beam source itself.

Namely, the lighting device of the invention is particularly suitable for outdoor use, e.g. for street lighting.

The device of the invention is susceptible of a number of changes and variants, within the inventive concept disclosed in the appended claims. All the details thereof may be replaced by other technically equivalent parts, and the materials may vary depending on different needs, without departure from the scope of the invention.

While the device has been described with particular reference to the accompanying figures, the numerals referred to in the disclosure and claims are only used for the sake of a better intelligibility of the invention and shall not be intended to limit the claimed scope in any manner.

The invention claimed is:

1. An outdoor lighting device for lighting a target, comprising:

a support structure;

a lighting unit stably associated with said support structure;

one or more reflecting surfaces defining a hollow body having an outwardly directed aperture; and one or more light beam sources of a light emitting diode (LED) type having predetermined full width at half maximum (FWHM) values of a respective luminous spectrum, said LED sources-being arranged into said hollow body to direct said light beams toward said reflecting surfaces;

wherein said outwardly directed aperture faces toward a target, all of said reflecting surfaces being arranged into an interior space of said hollow body and are so shaped that at least one of said LED sources has the FWHM of its luminous spectrum totally reflected by at least one of said reflecting surfaces and totally projected towards a target, for increased lighting efficiency of the device;

said one or more reflecting surfaces including first reflecting surfaces and second reflecting surfaces;

said LED sources being arranged along the peripheral borders of said hollow body and facing said second reflecting surfaces;

wherein said second reflecting surfaces are planar, are arranged centrally with respect to said hollow body and are converging towards said outwardly directed aperture.

2. Lighting device as claimed in claim 1, wherein an optical path of all the light beams emitted from said LED sources within their respective FWHM impinges upon at least one of said reflecting surfaces.

3. Lighting device as claimed in claim 1, wherein said first reflecting surfaces reflect the light beams that impinge upon them towards the target and/or towards said second reflecting surfaces and said second reflecting surfaces reflect the light beams that impinge upon them towards the target.

4. Lighting device as claimed in claim 1, wherein said aperture is at least partially closed by a lens.

5. Lighting device as claimed in claim 4, wherein said lens is of the refractive type.

6. Lighting device as claimed in claim 4, wherein said lens is of the Fresnel type.

7. Lighting device as claimed in claim 1, wherein at least one first portion of the optical path of the light beams within said FWHM of at least a first one of said LED sources has a direction diverging from the direction of the line that joins said at least a first one of said LED sources with a point within said aperture of said hollow body.

8. Lighting device as claimed in claim 7, wherein said optical path of the light beams within said FWHM of said at least a first one of said LED sources has at least two adjacent portions that define together an angle of at least 90°.

* * * * *